United States Patent [19]

Alfieri

[11] Patent Number: 4,509,539

[45] Date of Patent: Apr. 9, 1985

[54] HAIRPIECE WITH SIMULATED NATURAL HAIRLINE FRONT

[76] Inventor: Charles Alfieri, 250 East 63rd St., New York, N.Y. 10021

[21] Appl. No.: 578,205

[22] Filed: Feb. 8, 1984

[51] Int. Cl.[3] ..... A41G 3/00

[52] U.S. Cl. ..... 132/53

[58] Field of Search ..... 132/53, 54, 5; 156/73, 156/73.1

[56] References Cited

U.S. PATENT DOCUMENTS

| | | | |
|---|---|---|---|
| 851,384 | 4/1907 | Sleicher | 132/53 |
| 1,583,778 | 5/1926 | Conley | 132/53 |
| 3,139,093 | 6/1964 | Frishman | 132/53 |
| 3,420,249 | 1/1969 | Bonham | 132/53 |
| 3,421,521 | 1/1969 | Rich, Jr. | 132/53 X |
| 3,474,767 | 10/1969 | Ito | 132/53 |
| 3,642,010 | 2/1972 | Kuris | 132/5 |
| 3,835,868 | 9/1974 | Heck | 132/5 |
| 3,905,378 | 9/1975 | Levin | 132/5 |

*Primary Examiner*—Gregory E. McNeill
*Attorney, Agent, or Firm*—Kirschstein, Kirschstein, Ottinger & Israel

[57] ABSTRACT

A hairpiece for simulating a natural hairline at the front of the head of a user comprises a flexible shape-retaining foundation constituted of a light-weight lace mesh having a multitude of fine fibers crossing one another at intersections which are ultrasonically welded to strengthen the mesh to maintain and to retain a predetermined shape which conforms to the contour of the scalp area to be covered. A multitude of hairs is attached to the mesh substantially all the way up to a non-frayable unbound front edge thereof. The hair-attached foundation mesh is detachably secured to the scalp area, and the line of attached hair at the front of the mesh is reliably positioned on the front of the head of the user to simulate a natural hairline thereat. The method of making the hairpiece also is disclosed.

10 Claims, 6 Drawing Figures

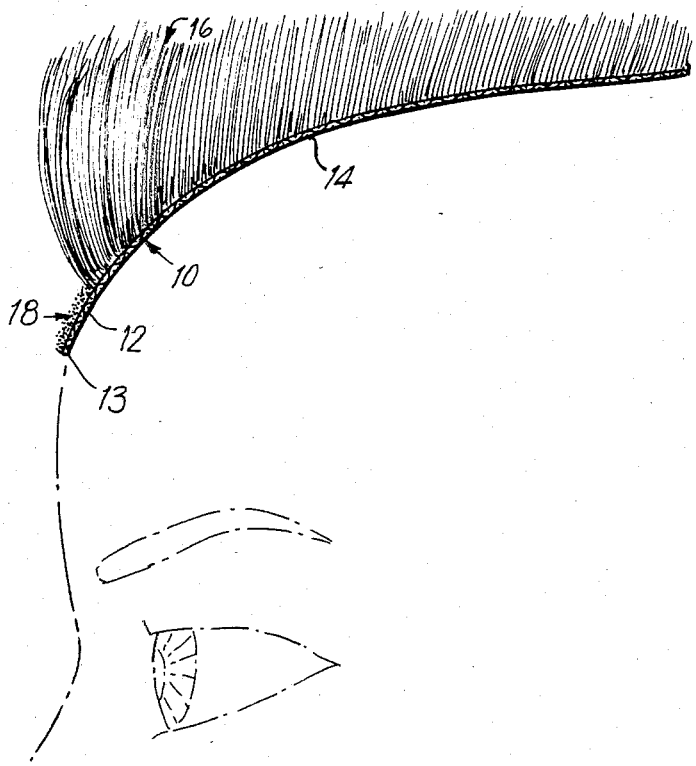
FIG. 1
PRIOR ART
FIG. 2
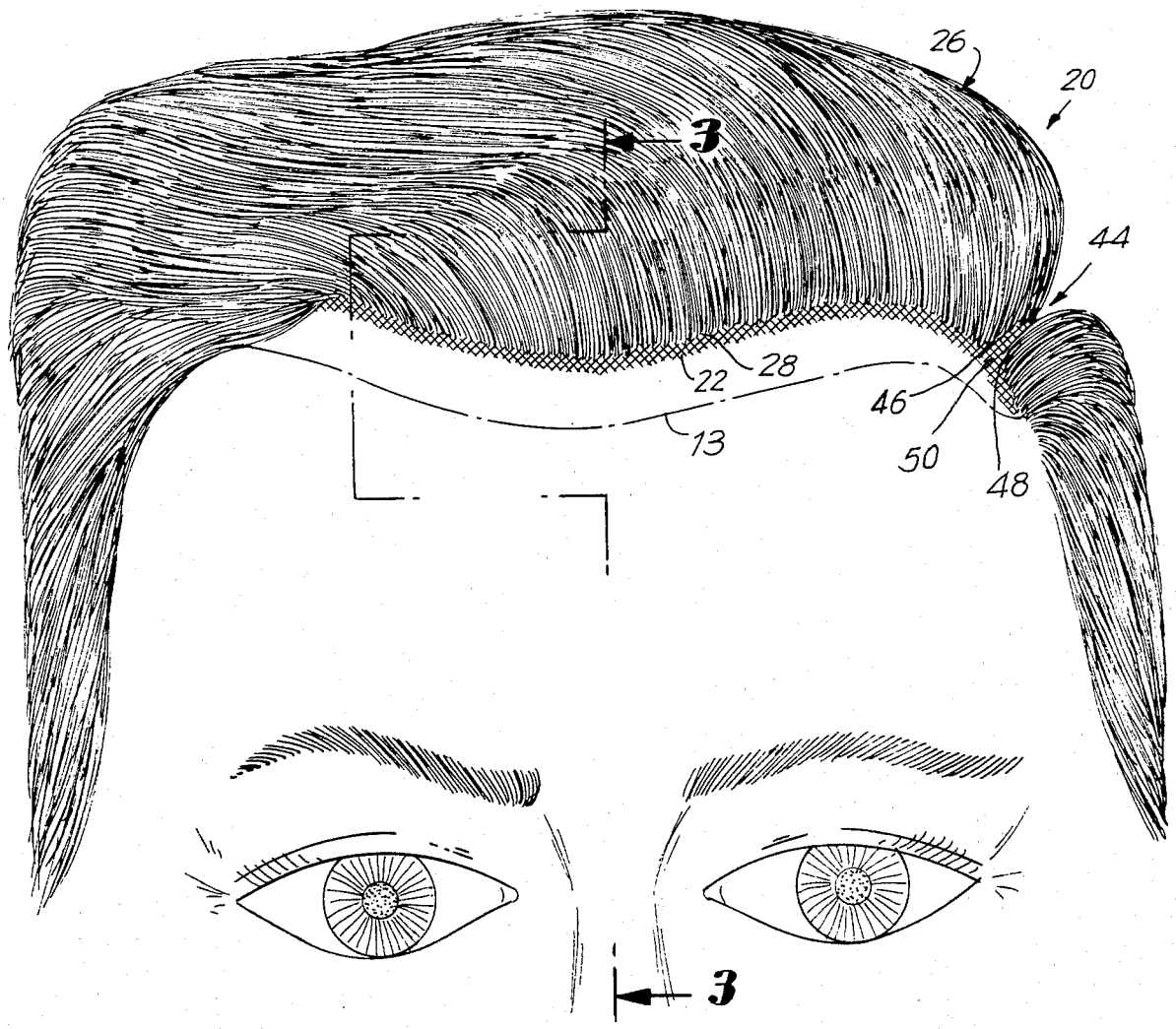

FIG. 3
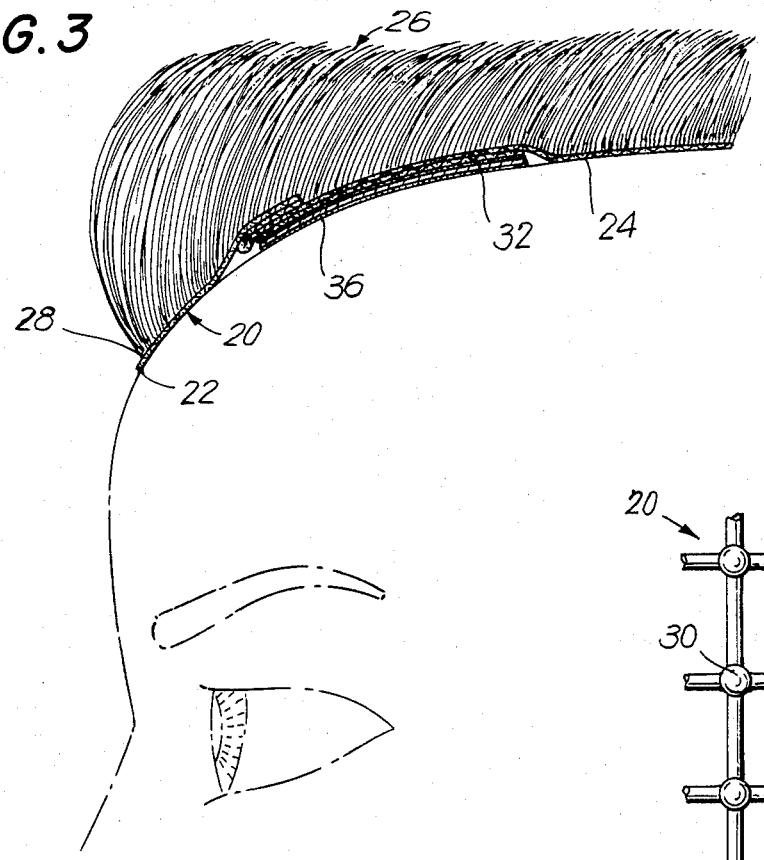
FIG. 5
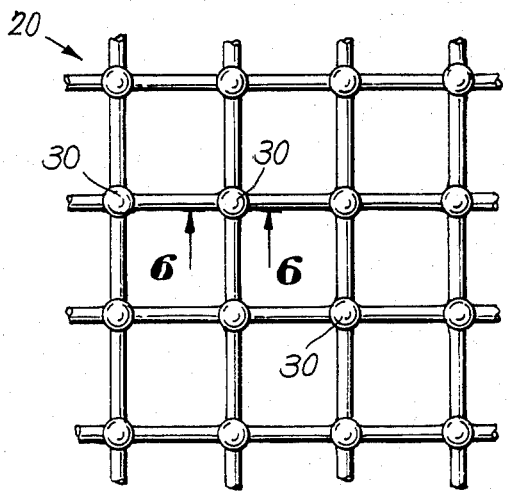
FIG. 4
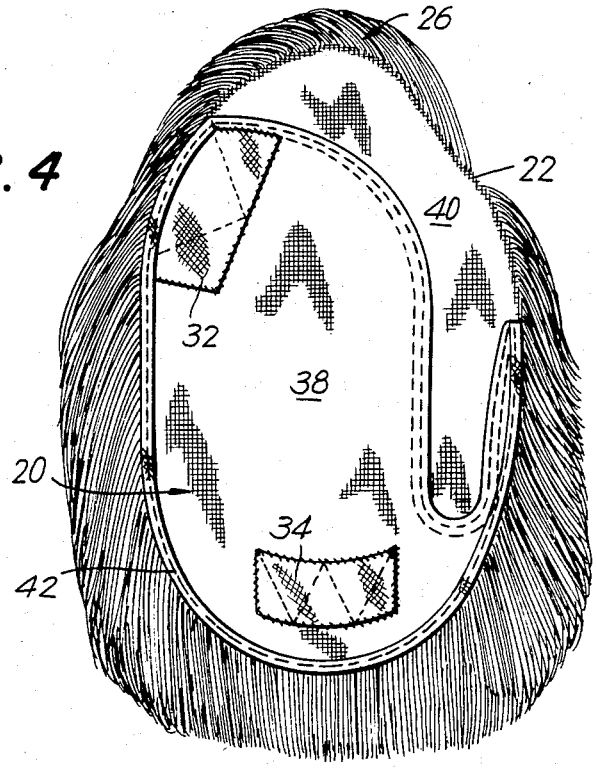
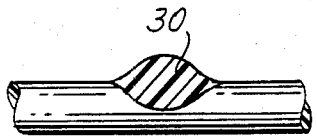
FIG. 6

HAIRPIECE WITH SIMULATED NATURAL HAIRLINE FRONT

BACKGROUND OF THE INVENTION

1. Field of the Invention

This invention generally relates to a hairpiece for covering an area on the scalp of a user and, more particularly, to a wear-durable hairpiece for simulating a natural hairline at the front of the head of the user, as well as to a novel method of making the hairpiece.

2. Description of the Prior Art

Various types of hairpieces and methods of making the same are well known. Typically, the hairpiece includes a base or foundation which conforms to the contour of the scalp area to be covered, and a multitude of hairs is attached to the foundation. In a so-called "hard front" hairpiece of the type disclosed in U.S. Pat. Nos. 3,421,521; 3,605,761; 3,971,392 and 4,202,359, an edge binding, preferably a ribbon strip or a fiber tape, is bent over and stitched along the entire peripheral edge of the foundation. However, the presence of the edge binding, particularly at the front of the head of the user, creates an embarrassing visual indication of the presence of a hairpiece unless the edge binding is concealed. This is typically accomplished by forwardly combing the attached hair to cover the edge binding. However, the forwardly combed hair also disguises the hairline at the upper forehead area of the user's head. Hence, the hard front hairpiece does not lend itself to brush-back hair styles wherein the hair is combed rearwardly of the hairline at the upper forehead area.

In order to permit a user requiring a hairpiece to be groomed with a brush-back hair style, a so-called "lace front" hairpiece of the type disclosed in U.S. Pat. No. 2,814,301 has been proposed. The lace front hairpiece has a foundation constituted of a lace mesh on which a multitude of hairs is attached, and a front lace extension on which no hairs are attached. The foundation mesh overlies the scalp area to be covered, and the front lace extension overlies the upper forehead area. The front lace extension extends substantially forwardly, typically on the order of ½ inch, away from the hairs attached to the foundation mesh. The front lace extension is used to create a natural hairline effect at the upper forehead area so that the lowest line of attached hair, when viewed from the front, appears to be actually growing out of the scalp and terminating at an acceptable hairline.

Although generally satisfactory for its intended purpose, the prior art lace front hairpiece suffers from many drawbacks. For example, the front lace extension must be adhered to the upper forehead area, not only to properly anchor the front of the hairpiece, but also to prevent its fraying, curling up, bending under itself, or otherwise deforming its shape. Any such deformation is unsightly and would, of course, readily indicate that a hairpiece is present, thereby detracting from the user's overall appearance. A special liquid adhesive that dries with a matte finish is typically applied over the front lace extension to make the presence of the same less noticeable and conspicuous to others. In addition, flesh-colored make-up may be applied over the extension to assist in making its appearance less obvious. The procedure of applying the adhesive, which typically takes several minutes, and waiting for the adhesive to dry, upon each use of the hairpiece, of course, necessitates the concomitant procedure of subsequently removing the hairpiece. This removal is typically effected by applying an acetone or similar substance over the adhesive to break the adhesive bond.

Over a period of time, the acetone will not only attack the extension itself and cause it to deform, but will also attack the skin on the user's upper forehead, thereby tending to dry out the skin. Often, the acetone undesirably seeps into the spaces between the attached hairs and attacks them. The deformed extension must, from time to time, be trimmed away to remove the curled up or bent under free end, thereby leaving a shorter extension by which to attach the front of the hairpiece and, of course, increasing the likelihood that the adhesive and/or the acetone will seep into the spaces between the hairs and attack the same.

The lace front hairpieces are typically used by actors, theatrical people and others whose occupations and vanity require the appearance of a natural hairline at the front of the head. To disguise the existence of the lace front extension, aside from using the aforementioned matte adhesives and flesh-colored make-up, the lace extension, as well as the entire lace foundation, are made of very fine fibers, thereby rendering the entire hairpiece very flimsy and fragile. Such fragile hairpieces require careful handling and typically last only about six to nine months. Such careful handling and short lifetime are of little concern to professional actors and the like where professional make-up artists and high budgets are readily available. However, such careful handling is usually beyond the skill of the average person, and such brief liftimes are too short for the average person who wishes a hairpiece to last for much longer time periods and to bear up well under the wear and tear of everyday use, particularly when the average user will apply the hairpiece every morning and remove it every night without the aid of professional make-up artists.

Other prior art hairpieces are described, for example, in U.S. Pat. Nos. 3,670,741; 3,722,517; 3,553,737 and 3,970,092. Still further, ultrasonic methods used for joining hairs and for the manufacture of locks of hair are disclosed in U.S. Pat. Nos. 3,642,010 and 4,377,427. Also, ultrasonic techniques are described in U.S. Pat. Nos. 3,447,540; 3,525,653 and 3,733,243.

SUMMARY OF THE INVENTION

Objects of the Invention

Accordingly, it is the general object of this invention to overcome the aforementioned drawbacks of the prior art.

Another object of this invention is to eliminate the above described disadvantages possessed by hard front and lace front hairpieces.

A further object of this invention is to substantially eliminate any embarrassing visual indication of the presence of a hairpiece.

Still a further object of this invention is to permit one to be groomed with brush-back hair styles.

Yet another object of this invention is to eliminate finishing or edge bindings at the front of a hairpiece.

Another object of this invention is to substantially eliminate any lace front extensions, as well as the entire procedure of applying a liquid adhesive over the lace front extension to anchor the same.

A further object of this invention is to provide a hairpiece which is rugged enough to be handled by the average person, which is easy to apply over the scalp area to be covered, which is easy to remove from the scalp area, and which is longlasting and durable.

Still a further object of this invention is to provide a hairpiece which retains its shape and does not shrink or otherwise distort in use.

Yet a further object of this invention is to provide a hairpiece which has no front edge region to fray, curl up, bend under or otherwise deform.

Still another object of this invention is to provide a hairpiece which simulates a natural hairline at the front of the head of the user and, if desired, a natural part.

A further object of this invention is to provide a unique method of making a hairpiece.

Brief Description of the Invention

In keeping with these objects and others which will become apparent hereinafter, one feature of the invention resides, briefly stated, in a wear-durable hairpiece, as well as in a novel method of making the same, for covering an area on the scalp of a user and for simulating a natural hairline at the front of the head of the user.

The hairpiece comprises a flexible shape-retaining foundation constituted of a light-weight lace mesh having a multitude of fine fibers crossing one another at intersections. The mesh has sonic welds at many of the intersections to strengthen and rigidify the mesh so that it can maintain and retain a predetermined shape which conforms to the contour of the scalp area to be covered. The mesh has a non-frayable unbound front edge which is defined solely by the ends of the fibers of the strenthened mesh.

Means are provided for attaching a multitude of hairs, either natural or artificial, to the mesh, preferably by knotting the hairs around the fibers which comprise the mesh. The hairs are attached over the entire mesh and substantially all the way up to the front edge thereof to provide a line of attached hair at the front edge without any mesh extension projecting substantially forwardly beyond the line of attached hair.

The line of attached hair is so connected as to come as close as possible to the free ends of the fibers of the mesh. Typically, no mesh extension projects forwardly of the line of attached hair, although, in some cases, for manufacturing reasons, a minimal extension on the order of about ⅛ inch maximum projects forwardly.

Means are also provided for detachably securing the hair-attached mesh to the scalp area for repetitive use and for positioning the line of attached hair at the front edge of the mesh on the front of the head of the user to simulate a natural hairline thereat. The securing means includes at least one stay connected to the underside of the mesh at a region remote from the front edge thereof. Adhesive means are preferably provided on the remote stay.

In accordance with an advantageous feature of this invention, the use of any mesh extension, as taught by the prior art lace front hairpieces, and the application and subsequent removal of a liquid adhesive over any such mesh extension which had been applied to assist in securing the hairpiece in place, are avoided. No longer is there any substantially projecting mesh extension which tends to fray, curl up or bend under after long use and, hence, provide an embarrassing visual indication of the presence of the hairpiece. No longer is it necessary to trim away any such deformed front mesh extension. It is no longer necessary to carefully apply and blot the liquid adhesive so as to avoid getting the adhesive into the spaces between the attached hairs, thereby attacking them. When removing the hairpiece, it is no longer necessary to apply acetone or a similar substance to break the adhesive bond. The careful application of the acetone to prevent its seepage into the spaces between the hairs, as well as attacking the skin at the upper forehead area, is avoided.

The elimination of the mesh extension which, in the prior art lace front hairpieces, typically extended forwardly about ½ inch, and its front-anchoring function, are achieved by the aforementioned strengthening and rigidifying of the light-weight lace mesh by sonic welding many, if not substantially all, of the intersections of the fine fibers of the mesh. This added strength to the overall mesh and its resistance to being stretched and pulled apart and otherwise distorted out of its predetermined shape permits the mesh extension to be eliminated because it is no longer necessary to provide a separate anchor at the very front of the hairpiece. It is sufficient to provide the aforementioned remote stay, and to leave the front edge region of the mesh undisturbed and, in other words, as close to a natural hairline condition as possible.

The novel method of making the hairpiece includes the steps of fitting a piece of conforming transparent plastic material to the head of the user, tracing a pattern on the fitted plastic material to outline the scalp area to be covered, taping over the fitted plastic material with shape-retaining tape to fix the shape of the fitted plastic material, and trimming the taped plastic material along the traced pattern.

Thereupon, the fixed shape of the trimmed plastic material is transferred to a head-shaped block, preferably constituted of wood, which serves as a convenient working surface. A molding substance such as wood putty can be used to build up any areas on the wooden block in order to duplicate the contour of the scalp area directly on the wooden block.

A flexible light-weight lace mesh having a multitude of fine fibers crossing one another at intersections is pre-shaped into a general head shape by blocking techniques and, thereupon, the mesh is ultrasonically welded at many, if not all, of the intersections, to impart strength and rigidity thereto. The ultrasonically welded mesh is thereupon fitted over the wooden block and heat-shaped with the aid of a heating gun which directs heated air at elevated temperatures toward the ultrasonically fitted mesh. The mesh, which is preferably made of a thermoplastic material, slightly melts and thus the contour of the mesh is matched to the contour of the head-shaped block.

Thereupon, at least one stay is connected to the mesh at a region remote from its front edge, and the next step is to attach a multitude of hairs to the mesh and substantially all the way up to the non-frayable unbound front edge to provide a line of attached hair at the front edge without any mesh extension projecting substantially forwardly beyond the line of attached hair. When an adhesive is applied to a mounting surface of the stay which faces the scalp area, the hair-attached mesh can be detachably secured to the scalp area. At the same time, the line of attached hair at the front edge of the mesh is reliably positioned on the front of the head of the user to simulate a natural hairline thereat.

Another feature resides in providing an elongated part on the hairpiece by attaching the hair on one side of the part so as to extend transversely in a predetermined direction away from the part, and by attaching the hair on the other side of the part so as to extend transversely in a different predetermined direction away from the part. When the sonic welded and strengthened mesh is positioned on the scalp, the parting lines of attached hair bordering the part appear to be growing out of the scalp, and the section of mesh between the part lines is essentially unnoticeable due to the relatively large size of its open-work holes, the fineness of the fibers, and the light-weight and scalp-complementary color of the fibers, whereby a natural part is simulated.

The novel features which are considered as characteristic of the invention are set forth in particular in the appended claims. The improved hairpiece itself, however, both as to its construction and the method of making the same, together with additional features and advantages thereof, will best be understood upon perusal of the following detailed description of certain specific embodiments with reference to the accompanying drawings.

BRIEF DESCRIPTION OF THE DRAWINGS

FIG. 1 is a side sectional view of a lace front hairpiece in accordance with the prior art as positioned on the scalp and upper forehead area of a user;

FIG. 2 is a front view of a hairpiece in accordance with this invention;

FIG. 3 is a side sectional view analogous to FIG. 1 and taken along line 3—3 of FIG. 2;

FIG. 4 is a bottom view of the hairpiece of FIG. 2 on a reduced scale;

FIG. 5 is a greatly enlarged view of a section of the ultrasonically-welded foundation mesh of the hairpiece of FIG. 2 prior to attachment of the hairs; and FIG. 6 is a sectional view taken along line 6—6 of FIG. 5.

DETAILED DESCRIPTION OF THE PREFERRED EMBODIMENT

Referring now to FIG. 1, which shows a prior art lace front hairpiece, reference numeral 10 identifies a lace mesh foundation having a front mesh extension 12 overlying the upper forehead area of the user, and a main mesh portion 14 overlying the scalp area to be covered. A multitude of hairs 16 is attached to the main mesh portion 14, but not to the front extension 12. The front extension 12 projects forwardly beyond the hair-attached main portion 14 downwardly over the forehead for a distance of about ½ inch, and terminates at a front edge 13. A liquid adhesive 18 is applied over the front extension 12 to anchor the same in position. The adhesive typically dries with a matte finish in an attempt to make the physical presence of the front extension 12 less visible and noticeable to viewers. Flesh-colored make-up may also be applied over the front extension 12 to help disguise its presence.

Referring now to the present invention and, more particularly, to FIGS. 2 and 3, reference numeral 20 generally identifies a flexible, yet shape-retaining, foundation, preferably constituted of a light-weight lace mesh having a multitude of fine fibers crossing one another at intersections. The intersections are best shown in FIG. 5, as explained below. The foundation 20 has a front marginal edge 22 at the upper forehead area of the user, and a main mesh portion 24 overlying the scalp area to be covered. A multitude of hairs 26, either natural or artificial, is attached, preferably by knotting each hair through the open-work holes of the mesh over the entire surface of the main mesh portion 24 and substantially all the way up to the front edge 22 to define a line 28 of attached hair.

The attached hairline 28 is situated as close as possible to the front edge 22 and, ideally, the line 28 is exactly on the front edge 22, although, as a practical matter, in terms of manufacturing the hairpiece, the line 28 may, in some cases, be slightly spaced rearwardly of the front edge 22 by typically no more than ⅛ inch. This slight spacing is shown in exaggerated scale in FIGS. 2 and 3. The location of the front edge 22 of the hairpiece, in accordance with this invention, is contrasted with the location of the front edge 13 of the lace front hairpiece of the prior art in FIG. 2, said front edge 13 of the prior art being illustrated by broken phantom lines. In contrast to the prior art, the present invention has no front extension and, even assuming, in a worst case condition, that a short front strip of no more than ⅛ inch extension exists between the line 28 of attached hair and the front edge 22, no adhesive is applied over this short strip.

Referring now to FIG. 5, the foundation mesh 20 is strengthened and rigidified to resist being stretched and pulled apart and otherwise being distorted by ultrasonic welds 30 formed at many, and preferably all, of the intersections of the fine fibers which comprise the mesh. As shown in FIG. 6, the opposing surfaces of the crossing fibers actually partially melt and liquefy so that the opposing fiber surfaces are surface-tacked to one another. The mesh is preferably woven of monofilament fibers which are advantageously of about six mils diameter which is fine enough to be virtually unnoticeable. The fibers preferably are colored with the appropriate flesh-toned shade of the user's scalp to blend in with his skin color. The fibers preferably are constituted of a synthetic thermoplastic material such as nylon or rayon. The additional strength and rigidity imparted to the mesh contribute, in large measure, to the fact that no adhesive need be applied at the front of the hairpiece at the line 28 of attached hair. The strengthened mesh maintains and retains a predetermined shape conforming to the contour of the scalp area to be covered. By using an ultrasonically-welded mesh, the resulting foundation can be created out of very light-weight fine fibers and still have enough form-retaining rigidity. The strengthened mesh keeps its shape, is rugged and durable in use, and can last for years.

Means are provided for detachably securing the hair-attached foundation to the scalp area for repetitive, typically daily, use, and for readily and reliably positioning the line 28 of attached hair at the front edge of the mesh on the front of the head of the user to thereby simulate a natural hairline thereat. As shown in FIGS. 3 and 4, the securing means includes at least one, and preferably a pair, of flesh-colored tape stays 32, 34 sewn along their rectangular peripheries to the underside of the mesh at a region remote from the front edge 22. Each remote stay is constituted of a fabric material, e.g. silk, and has a lower mounting surface facing the scalp area and on which an adhesive means such as a double-sided adhesive tape 36 is applied. A single-sided adhesive tape or even a liquid adhesive could similarly be applied to each stay.

The foundation mesh 20 can be of unitary or multi-part construction. As shown in FIG. 4, the main mesh portion 24 includes a rear cap portion 38 which is sewn to a front brim portion 40. The cap and brim portions 38, 40 are oriented relative to each other at differing biases to accommodate different combing directions for the user to style his hair. A finishing border 42 includes a strip of binding material which is bent over and sewn along the peripheral edge of the foundation, except along the front edge 22 at the front of the user's head. The front edge 22 is unbound, i.e. has no border. The front edge 22 is also non-frayable, does not curl over or bend under itself or otherwise deform due to the ultrasonic welding of the mesh which causes the mesh to retain its shape. The front edge 22 is defined solely by the free ends of the fibers of the strengthened mesh. The finishing border is optional.

In accordance with another advantageous aspect of this invention, the above described hairpiece is made as follows: First, a piece of transparent plastic material such as Saranwrap is placed over the head of a user and pulled tightly down so as to conformingly fit the plastic material on the user's head. A pattern is then traced with a marker on the fitted plastic material to outline the scalp area to be covered. Masking or other shape-retaining tape is then taped over the fitted plastic material to fix the shape thereof. After the taped plastic material is removed from the user's head, it is trimmed along the traced pattern which is visible from the non-taped underside of the shaped plastic material.

The next step is to transfer the fixed shape of the trimmed plastic material to a wooden head-shaped block. Generally, a set of such wooden blocks of different sizes is available, and the wooden block which comes closest to the fixed shape of the trimmed plastic material is selected. Then, if necessary, a moldable substance such as wood putty or clay is applied over the wooden block to build up any low areas. Wood may also be removed, if necessary, from any high areas on the block. Eventually, the fixed shape of the trimmed plastic will be duplicated on the wooden block which now serves as a convenient work surface.

The aforementioned lace mesh foundation preferably is pre-shaped and pre-blocked to a general head shape. Thereupon, the lace mesh is placed under an ultrasonic emitter of an ultrasonic device to form ultrasonic welds at the intersections of the fibers comprising the mesh. The ultrasonically-welded mesh is then fitted over the shaped wooden block by being placed thereon and then pulled tightly down into a snug conforming relationship therewith. The fitted ultrasonically-welded mesh is pinned along its lower edge to maintain its close fit to the wooden block.

A heat gun is then used to direct elevated air temperatures on the order of 500° F. onto the ultrasonically-welded fitted mesh to heat-shape the same to assume the shape of the wooden block. The heat gun actually partially melts the mesh. The heat-shaped mesh is then allowed to cool by leaving it exposed to room air temperature. The cooled mesh whose contour now matches the contour of the scalp area to be covered may then be removed from the shaped wooden block.

In further accordance with the method of this invention, one or more parts of the foundation mesh such as cap and brim parts 38, 40 are sewn to each other at the correct bias to accommodate different hair-combing directions. One or more flesh-colored tape stays, e.g. 32, 34, may thereupon be sewn to the underside of the mesh at a region remote from the front edge 22. A finishing border or edge binding 42 may thereupon be bent over the peripheral edge of the foundation, except along the front edge 22, and be sewn by stitching. Finally, the hairs are knotted, usually by professional wig makers, to the mesh over the entire surface area thereof, and substantially all the way up to the front edge 22.

To detachably secure the hairpiece to the scalp area, the user applies an adhesive, such as a double-sided tape or, in some cases, a one-sided surgical tape, or a liquid adhesive, over the stays. Once properly positioned on the head, the line 28 of attached hair is oriented on the front of the head in its proper position to thereby reliably simulate a natural hairline at the upper forehead area of the user.

In order to also reliably simulate a natural part 44 (see FIG. 2) on one side of the head of the user, the attached hair on one side of the elongated part is arranged to extend in one predetermined direction away from and transversely of the part; whereas, the attached hair on the other side of the elongated part is arranged to extend in another different direction away from and transversely of the part. The lines 46 and 48 of attached hair bordering the part appear to be growing out of the scalp. The exposed section 50 of the mesh between the parting lines 46, 48 is essentially unnoticeable due to the relatively large-sized holes in the mesh, the fineness of the fibers bounding the holes, the light-weight nature of the fibers, and the color of the fibers which blends in with the color of the scalp. The shape-retaining mesh insures that the parting lines not only remain in place on the scalp, but also do not shift in any direction relative to each other.

As used throughout the specification and claims, the term "fine" is intended to signify the light weight and small diameter of the fibers comprising the mesh. As described above, the monofilament fibers can have a diameter that ranges anywhere from about three to about ten mils, although, in the preferred embodiment, six mils is employed. As shown in FIG. 6, the crossing fibers bound generally square-shaped holes and, in the preferred embodiment, there are about 22 fibers per linear inch of mesh. In the preferred embodiment, I use woven synthetic Type 6 nylon having a weight of about one ounce per square yard.

It will be understood that each of the elements described above, or two or more together, may also find a useful application in other types of arrangements differing from the type described above.

While the invention has been illustrated and described as embodied in a hairpiece, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. A wear-durable hairpiece for covering an area on the scalp of a user, and for simulating a natural, visible hairline that appears to be growing directly out of the scalp at the front of the head of the user, comprising:

(a) a flexible, light-weight, shape-retaining lace mesh foundation constituted of a first set of spaced-apart fine fibers sonically bonded to a second set of spaced-apart fine fibers to strengthen the foundation and to retain the same in a predetermined shape which conforms to the contour of the scalp area to be covered, said second set extending transversely across said first set and bounding open spaces therewith, said foundation having an unbordered front region at the front of the head the user, said unbordered front region terminating at a non-frayable, unbound front edge which is defined by the ends of the fibers of the first and second sets;

(b) a multitude of hairs attached to the foundation substantially up to the front edge thereof, said attached hairs including a plurality of self-standing hairs knotted to the unbordered front region of the foundation along the front edge and extending in the immediate vicinity of the scalp in a generally vertically-disposed direction away from the scalp at the front of the head of the user, said vertically-disposed, self-standing hairs being spaced apart from one another along the front edge to permit the scalp of the user to be visible through the open spaces of the foundation; and (c) means for detachably securing the hair-attached foundation to the scalp area for repetitive covering of the same, and for positioning the vertically-disposed, self-standing, spaced-apart hairs along the front edge on the front of the head of the user to simulate a natural, visible hairline that appears to be growing directly out of the scalp at the front of the head of the user.

2. The hairpiece as defined in claim 1, wherein said attached hairs include a first group of hairs knotted to the foundation along an elongated first parting line which extends rearwardly from the front edge, and a second group of hairs knotted to the foundation along an elongated second parting line which extends rearwardly from the front edge and generally parallel to the first parting line, said parting lines being spaced slightly apart to permit the scalp of the user to be visible through the open spaces of the foundation in the region between the parting lines, to thereby simulate a natural, visible part.

3. The hairpiece as defined in claim 1, wherein the foundation is a woven synthetic thermoplastic material.

4. The hairpiece as defined in claim 3, wherein the thermoplastic material is nylon.

5. The hairpiece as defined in claim 1, wherein the foundation mesh has a color which matches the color of the scalp of the user.

6. The hairpiece as defined in claim 1, wherein the fibers are ultrasonically bonded.

7. The hairpiece as defined in claim 1; and further comprising a finishing border extending around the peripheral edge of the foundation at other than the front edge thereof, said border being sewn to the foundation.

8. The hairpiece as defined in claim 1, wherein said securing means includes at least one stay sewn to the underside of the foundation at a region remote from the front edge thereof, said remote one stay having a mounting surface facing the scalp area, and wherein said securing means includes adhesive means mounted on the mounting surface for detachably securing the foundation to the scalp area.

9. The hairpiece as defined in claim 1, wherein the fibers are monofilaments of about six mils diameter.

10. The hairpiece as defined in claim 8, wherein said adhesive means is a double-sided adhesive tape.

* * * * *